US010526816B2

(12) United States Patent
Chiou et al.

(10) Patent No.: US 10,526,816 B2
(45) Date of Patent: Jan. 7, 2020

(54) DOOR LOCK HAVING LOCKING MECHANISM

(71) Applicant: TONG LUNG METAL INDUSTRY CO., LTD, Chiayi County (TW)

(72) Inventors: Ming-Shyang Chiou, Chiayi (TW); Yu Lin, Chiayi (TW)

(73) Assignee: TONG LUNG METAL INDUSTRY CO., LTD., Chiayi County (TW)

( * ) Notice: Subject to any disclaimer, the term of this patent is extended or adjusted under 35 U.S.C. 154(b) by 624 days.

(21) Appl. No.: 15/361,201

(22) Filed: Nov. 25, 2016

(65) Prior Publication Data

US 2017/0152681 A1 Jun. 1, 2017

(30) Foreign Application Priority Data

Nov. 27, 2015 (TW) ..... 104219050 U

(51) Int. Cl.
*E05B 63/00* (2006.01)
*E05B 47/06* (2006.01)
(Continued)

(52) U.S. Cl.
CPC ..... *E05B 63/0065* (2013.01); *E05B 1/003* (2013.01); *E05B 47/0012* (2013.01);
(Continued)

(58) Field of Classification Search
CPC ..... Y10T 292/0834; Y10T 292/0837; Y10T 292/0839; Y10T 292/084; Y10T 292/0844; Y10T 292/0977; Y10T 292/098; Y10T 292/0982; Y10T 292/0984; Y10T 292/0985; Y10T 292/0989; Y10T 292/099; Y10T 292/0991; Y10T 70/5226; Y10T 70/5239; Y10T 70/5243; Y10T 70/523; Y10T 70/5235; Y10T 70/5677; Y10T 70/5673; Y10T 70/5819; Y10T 70/5823; Y10T 70/5827; Y10T 70/5832; Y10T 70/5496; Y10T 70/5805; Y10T 70/5416;
(Continued)

(56) References Cited

U.S. PATENT DOCUMENTS 4,995,248 A * 2/1991 Liu ..... E05B 47/0692 70/107
5,987,945 A * 11/1999 Ruano Aramburu ..... E05B 47/0692 70/107
2002/0053227 A1* 5/2002 Chiang ..... E05B 47/0692 70/107

FOREIGN PATENT DOCUMENTS

DE 202012102218 U1 * 9/2012 ..... E05B 63/16
DE 202012103657 U1 * 10/2012 ..... E05B 63/16
EP 2385199 B1 * 10/2017

* cited by examiner

*Primary Examiner* — Alyson M Merlino
(74) *Attorney, Agent, or Firm* — Burris Law, PLLC

(57) ABSTRACT

In a door lock, a locking mechanism includes an outer wheel, an inner wheel disposed inside the outer wheel and operable to rotate relative to the outer wheel, a clutch member disposed in the inner wheel and normally biased to radially extend from the inner wheel into the outer wheel to interengage the inner and outer wheels, and an arm plate sleeved around the inner wheel. When the inner wheel rotates in a first direction, the arm plate is driven by the inner wheel to actuate the deadbolt. When the inner and outer wheels are interengaged, the inner wheel drives the outer wheel by rotating in a second direction. When the inner wheel disengages from the outer wheel, rotation of the inner wheel in the first or second direction is idle relative to the outer wheel.

24 Claims, 13 Drawing Sheets

(51) Int. Cl.

| | |
|---|---|
| ***E05B 59/00*** | (2006.01) |
| ***E05B 1/00*** | (2006.01) |
| ***E05B 47/00*** | (2006.01) |
| ***E05B 63/14*** | (2006.01) |
| ***E05B 63/16*** | (2006.01) |
| *E05B 15/04* | (2006.01) |

(52) U.S. Cl.
CPC ..... *E05B 47/0603* (2013.01); *E05B 59/00* (2013.01); *E05B 63/146* (2013.01); *E05B 63/16* (2013.01); *E05B 2001/0076* (2013.01); *E05B 2015/0496* (2013.01)

(58) Field of Classification Search
CPC ..... Y10T 70/7051; Y10T 70/7107; Y10T 70/7062; Y10T 70/7102; Y10T 70/7113; E05B 63/0065; E05B 63/146; E05B 63/16; E05B 1/003; E05B 47/0012; E05B 47/0603; E05B 59/00; E05B 2001/0076; E05B 2015/0496
See application file for complete search history.

DOOR LOCK HAVING LOCKING MECHANISM

CROSS-REFERENCE TO RELATED APPLICATION

This application claims priority of Taiwanese Patent Application No. 104219050, filed on Nov. 27, 2015.

FIELD

The disclosure relates to a door lock, and more particularly to a locking mechanism mounted in a housing of the door lock and capable of operating a deadbolt to allow a user to lock a door by lifting simply an outer handle of the door.

BACKGROUND

A conventional box door lock includes a deadbolt and a latch bolt. The latch bolt is normally driven by inner and outer handles, a key-operated lock unit, or a rotary knob to move a latch head of the latch bolt from a latching position to an unlatching position, such that a door can be opened. However, when a user operates the outer handle by pressing downward the same, only the latch bolt can be driven to move to the unlatching position from the latching position. To actuate the deadbolt to move to a locking position, a key is required to operate the door lock thereby causing inconvenience to the user.

SUMMARY

Therefore, an object of the disclosure is to provide a door lock with a locking mechanism that can drive a deadbolt to move to a locking position when a user lifts or turns upward an outer handle.

According to one aspect of the disclosure, the door lock includes a housing, a deadbolt mounted in the housing, and a locking mechanism. The locking mechanism includes an outer wheel, an inner wheel, a clutch member, a clutch spring and an arm plate. The outer wheel is rotatably mounted in the housing, and has a receiving space, and an outer wheel recess communicated with the receiving space. The inner wheel is disposed partially and coaxially inside the receiving space of the outer wheel, and extends partially out of the outer wheel. The inner wheel is operable to rotate relative to the outer wheel in either one of two opposite first and second directions, and has an inner wheel recess alignable or dis-alignable with the outer wheel recess when the inner wheel rotates within the receiving space of the outer wheel. The inner wheel recess is radially juxtaposed with the outer wheel recess when being aligned with the outer wheel recess. Both of the clutch member and the clutch spring are disposed in the inner wheel recess. The clutch member is urged by the clutch spring to extend partially and radially into the outer wheel recess so as to interengage the inner and outer wheels. The clutch member is retractable into the inner wheel recess from the outer wheel recess to disengage the outer wheel from the inner wheel when the clutch member is pushed against the clutch spring. The arm plate is sleeved around the inner wheel outwardly of the outer wheel for actuating the deadbolt. When the inner wheel inter-engages with or disengages from the outer wheel, rotation of the inner wheel in the first direction drives the arm plate to actuate the deadbolt, and rotation of the inner wheel in the second direction is idle relative to the arm plate.

According to another aspect of the disclosure, a door lock includes a housing, a deadbolt mounted in the housing, and a locking mechanism. The locking mechanism includes two coaxially juxtaposed outer wheels, two inner wheels respectively and coaxially disposed in the outer wheels, a clutch member, a clutch spring, and an arm plate. Each of the outer wheels is rotatably mounted in the housing, and has an outer wheel central through hole, an outer wheel arcuated groove communicated with the outer wheel central through hole at a radially off-center position, and an outer wheel recess communicated with the outer wheel arcuated groove oppositely of the outer wheel central through hole. The outer wheel recess is radially juxtaposed with the outer wheel arcuated groove. Each of the inner wheels has an inner wheel body extending through the outer wheel central through hole and formed with an inner wheel central through hole, and an arcuated protruding body radially protruding from the inner wheel body, and received in the outer wheel arcuated groove. The arcuated protruding body is limitedly rotatable relative to the outer wheel arcuated groove, and has an inner wheel recess alignable or dis-alignable with the outer wheel recess when the arcuated protruding body rotates within the outer wheel arcuated groove. The inner wheel recesses of the inner wheels are juxtaposed with each other, and the outer wheel recesses of the outer wheels are juxtaposed with each other. Both of the clutch member and the clutch spring are disposed in the inner wheel recesses. The clutch member is urged by the clutch spring to extend partially and radially into the outer wheel recesses so as to respectively interengage the inner wheels with the outer wheels. The clutch member is retractable into the inner wheel recesses from the outer wheel recesses to respectively disengage the outer wheels from the inner wheels when the clutch member is pushed against the clutch spring. The arm plate is sleeved around one of the inner wheels outwardly of the corresponding one of the outer wheels for actuating the deadbolt. When the inner wheels are engaged with or disengaged from the outer wheels, the one of the inner wheels drives the arm plate to actuate the deadbolt.

According to still another of the disclosure, a door lock includes a housing, a deadbolt mounted in the housing and a locking mechanism. The locking mechanism includes at least one outer wheel rotatably mounted in the housing, at least one inner wheel, a clutch member and an arm plate. The at least one inner wheel is disposed coaxially inside the at least one outer wheel, and is operable to rotate relative to the at least one outer wheel in either one of first and second directions. The clutch member is disposed in the at least one inner wheel, and is normally biased to radially and partially move from said at least one inner wheel into the at least one outer wheel so as to interengage the at least one inner and outer wheels. The arm plate is sleeved around the at least one inner wheel outwardly of the at least one outer wheel for actuating the deadbolt. When the at least one inner wheel inter-engages with or disengages from the at least one outer wheel, rotation of the at least one inner wheel in the first direction drives the arm plate to actuate the deadbolt, and rotation of the at least one inner wheel in the second direction is idle relative to the arm plate. When the at least one inner wheel inter-engages the at least one outer wheel, rotation of the at least one inner wheel in the second direction drives the at least one outer wheel, and rotation of the at least one inner wheel in the first direction is idle relative to the at least one outer wheel. When the at least one inner wheel disengages from the at least one outer wheel, rotation of the at least one inner wheel in the first or second direction is idle relative to the at least one outer wheel.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
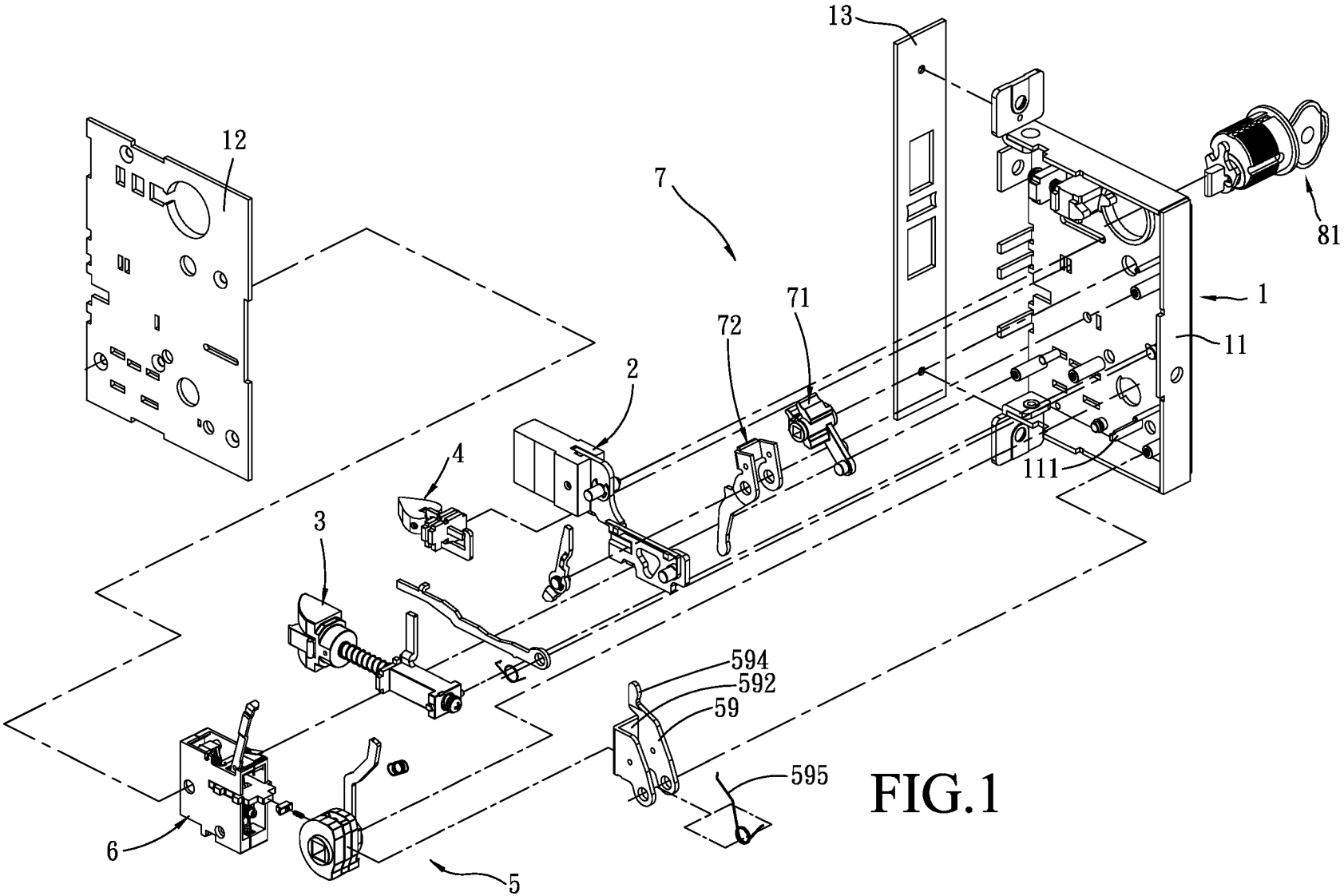
FIG. 1 is an exploded perspective view of an embodiment of a door lock according to the disclosure.
Figure 12:
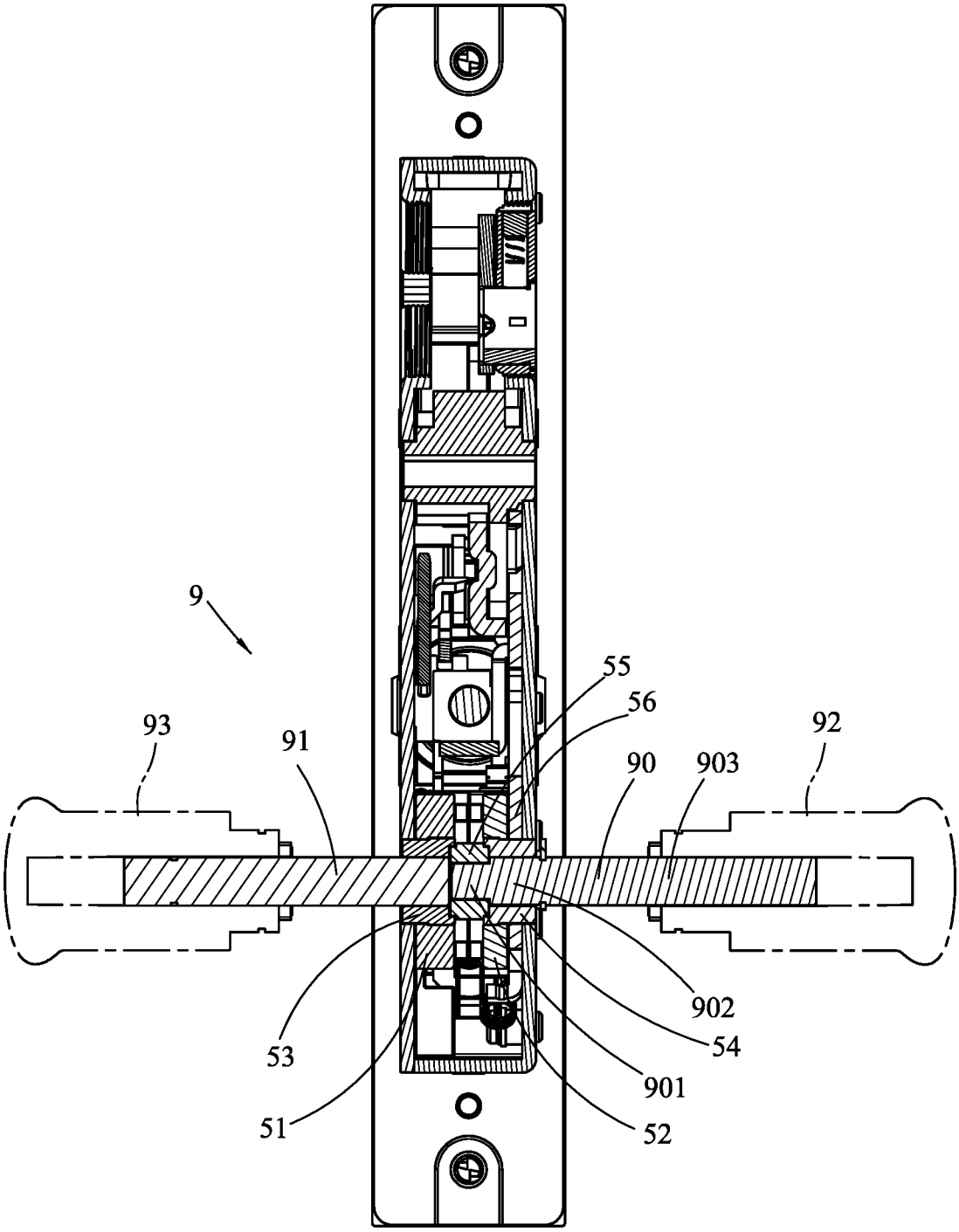
FIG. 12 is a sectional view of the embodiment.
Figure 14:
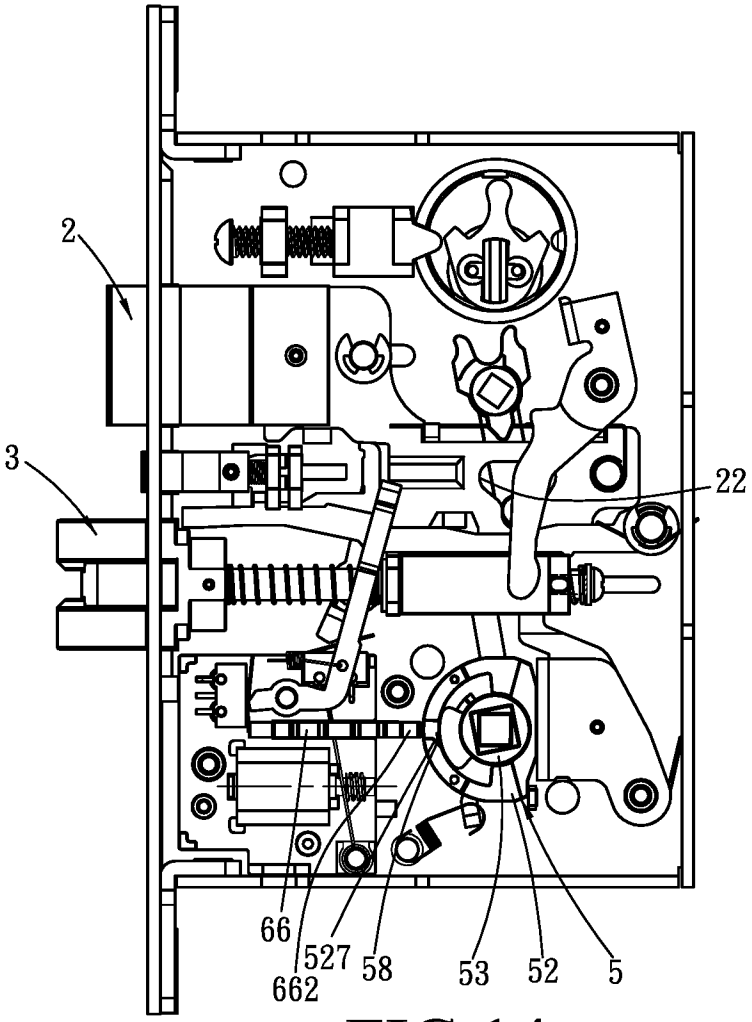
FIG. 14 is a side view of the door lock with the portion of the housing and the portion of the shell of the electronic controller omitted, wherein the deadbolt moves between the unlocking position and a locking position, and the triggering portion of the triggering plate of the electronic controller is separated from the locking mechanism.

Referring to FIGS. 1 and 12, the embodiment of the disclosure is shown to be a box door lock adapted to be mounted to a door (not shown), and includes a housing 1, a deadbolt 2, a latch bolt 3, a locking mechanism 5, an anti-burglar latch 4, an electronic controller 6, a lever unit 7, a key-operated lock 81, a shaft unit 9 (see FIG. 12), and inside and outside handles 92, 93 (see FIG. 12). A user may lift or turn upward the outside handle 93 to drive the locking mechanism 5 and the lever unit 7 so that the deadbolt 2 extends out of the housing 1 to lock the door. The housing 1 includes a housing base 11, a housing cover 12, and a face plate 13.

Figure 3:
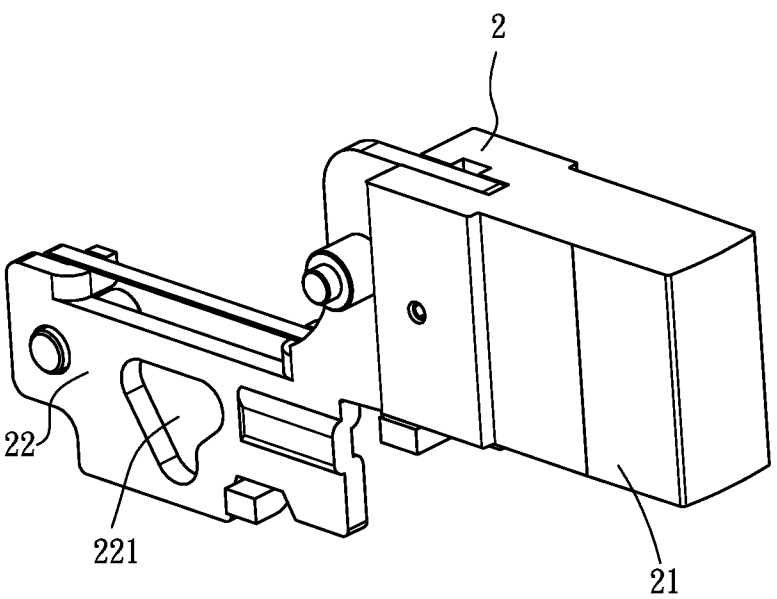
FIG. 3 is another perspective view of the deadbolt of the embodiment.
Figure 2:
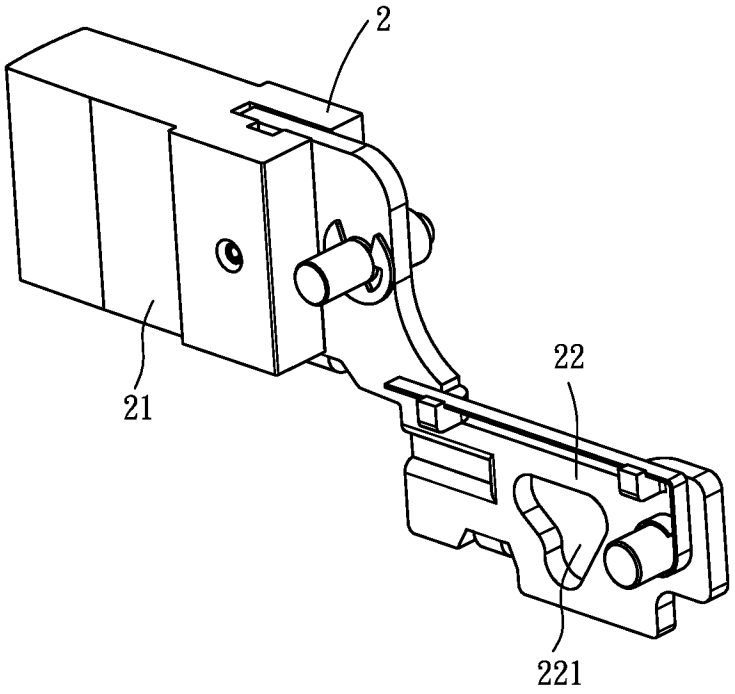
FIG. 2 is a perspective view of a deadbolt of the embodiment.

Referring to FIGS. 1 to 3, the deadbolt 2 is mounted in the housing 1, is operable to move between a locking position and an unlocking position, and has a deadbolt head 21, a coupling portion 22 connected to the deadbolt head 21, and a coupling hole 221.

Figure 4:
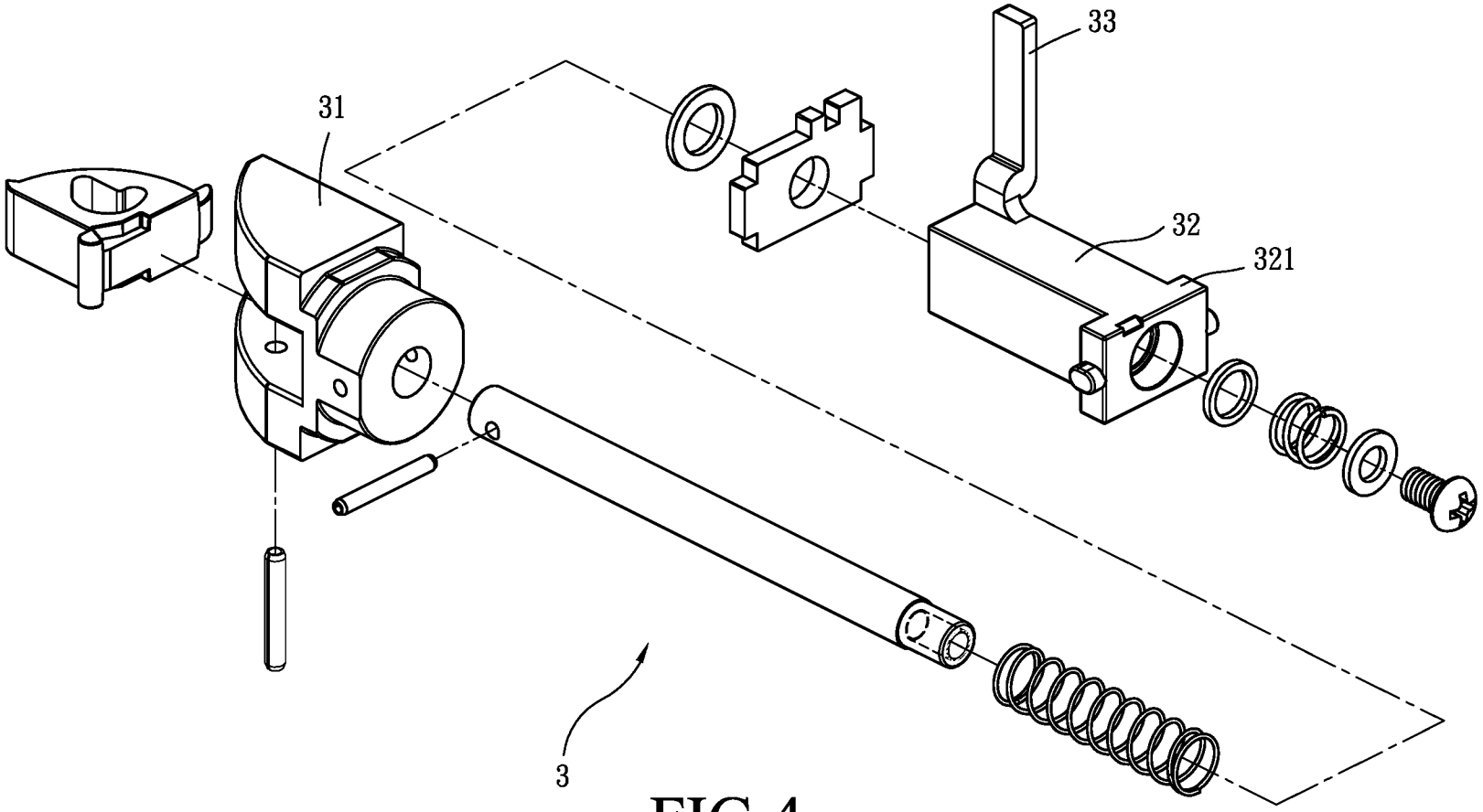
FIG. 4 is an exploded perspective view of a latch bolt of the embodiment.
Figure 5:
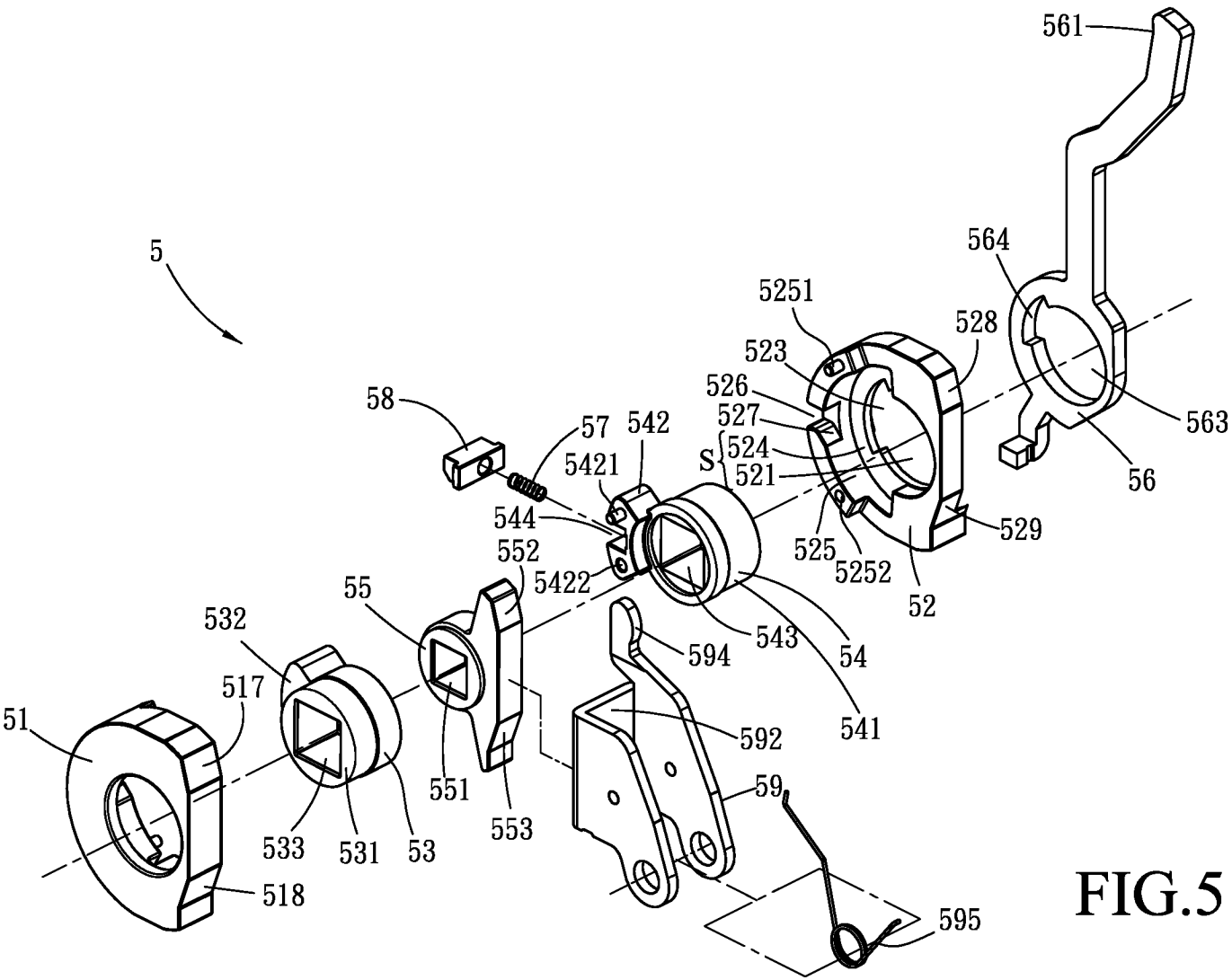
FIG. 5 is an exploded perspective view of a locking mechanism of the embodiment.

Referring to FIGS. 1 and 4, the latch bolt 3 is mounted in the housing 1, and has a latch bolt head 31, a latch bolt body 32 connected to the latch bolt head 31, a driven part 321, and a driving part 33 extending upwardly from the driven part 321.

Referring to FIGS. 1, 5 6, 10 and 11, the locking mechanism 5 is mounted in the housing 1, and includes two outer wheels 51, 52, two inner wheels 53, 54, a rotary member 55, an arm plate 56, a clutch spring 57, a clutch member 58 and a latch pusher 59. It should be noted that, the number of the outer wheels 51, 52 and the number of the inner wheels 53, 54 may be varied in other embodiments. The outer wheels 51, 52 are rotatably mounted in the housing 1, and are coaxially juxtaposed relative to each other. Each outer wheel 51, 52 has an outer wheel central through hole 511, 521, an outer wheel arcuated groove 513, 524, an outer wheel recess 515, 526, an outer wheel inclined face 516,527, a driving segment 517, 528, and a stopping segment 518, 529. The outer wheel central through hole 511, 521 and the outer wheel arcuated groove 513, 524 of each outer wheel 51, 52 cooperatively form a receiving space (S) (see FIGS. 5, 6) to receive a corresponding one of the inner wheel 53, 54.

For the outer wheel 51, the outer wheel arcuated groove 513 is communicated with the outer wheel central through hole 511 at a radially off-center position. The outer wheel recess 515 is communicated with the outer wheel arcuated groove 513 oppositely of the outer wheel central through hole 511, and is radially juxtaposed with the outer wheel arcuated groove 513. The outer wheel arcuated groove 513 is bounded by an arcuated groove wall 514, and the outer wheel recess 515 extends radially through the arcuated groove wall 514 from an inner surface to an outer surface thereof. The arcuated groove wall 514 has an outer wheel connecting rod 5141 and an outer wheel connecting hole 5142. The outer wheel inclined face 516 is formed on a part of the arcuated groove wall 514 at a juncture of the outer wheel recess 515 and the outer wheel arcuated groove 513 (i.e., the part of the arcuated groove wall bounding a lower side of the outer wheel recess 515 in FIG. 6). The driving segment 517 and the stopping segment 518 are spaced apart from each other, and are formed on a portion of a peripheral surface of the outer wheel 51 which faces toward the latch pusher 59.

The outer wheel 52 has a main structure identical to the outer wheel 51, and further has an outer wheel arctuated opening 523, a stopping block 5212, and an axially projecting arcuated flange 5211 disposed on an outer surface of the outer wheel 52 opposite to the outer wheel 51. The outer wheel arcuated opening 523 is adjacent to the arm plate 56 and is axially aligned with the outer wheel arcuated groove 524. The outer wheel arcuated opening 523 is communicated with the outer wheel arcuated groove 524 and the outer wheel central through hole 521. The stopping block 5212 together with the stopping segments 518, 529 are provided for engaging a stop post 111 (see FIG. 1) disposed in the housing 1 and for limiting the outer wheels 51, 52 to rotate in a uni-direction (i.e., to rotate only in a second direction (D2)). The axially projecting arcuated flange 5211 extends to and contacts a circumferential outer surface 560 of the arm plate 56 for stabilizing the arm plate 56. An arcuated groove wall 525 of the outer wheel 52 has an outer wheel connecting rod 5251 and an outer wheel connecting hole 5252. The outer wheel connecting rod 5141 of the outer wheel 51 engages the outer wheel connecting hole 5252 of the outer wheel 52, and the outer wheel connecting rod 5251 of the outer wheel 52 engages the outer wheel connecting hole 5142 of the outer wheel 51. In such manner, the outer wheels 51, 52 are securely inter-connected and are co-rotatable, and the outer wheel recesses 515, 526 of the outer wheels 51, 52 are juxtaposed and inter-communicated with each other.

The inner wheels 53, 54 are coaxially mounted inside and extend partially out of the respective the outer wheels 51, 52, and are operable to rotate relative to the outer wheels 51, 52 in either one of two opposite first and second directions (D1, D2) through use of the shaft unit 9. Each of the inner wheels 53, 54 has an inner wheel body 531, 541, an arcuated protruding body 532, 542, an inner wheel central through hole 533, 543, and an inner wheel recess 534, 544.

For the inner wheel 53, the inner wheel body 531 extends through the outer wheel central through hole 511 of the outer wheel 51, and is formed with an inner wheel central through hole 533. The arcuated protruding body 532 radially protrudes from the inner wheel body 531, is received in the outer wheel arcuated groove 513, and is limitedly rotatable relative to the outer wheel arcuated groove 513. The arcuated protruding body 532 further has an inner wheel connecting rod 5321 and an inner wheel connecting hole 5322. The inner wheel recess 534 is formed inside the arcuated protruding body 532 and is alignable or dis-alignable with the outer wheel recess 515 of the outer wheel 51 when the arcuated protruding body 532 rotates within the outer wheel arcuated groove 513. The inner wheel recess 534 is radially juxtaposed with the outer wheel recess 515 when being aligned with the outer wheel recess 515.

The inner wheel 54 has a main structure identical to the inner wheel 53, and further has an arm-driving tongue 545 projecting radially from the inner wheel body 541 and axially aligned with a middle part of the arcuated protruding body 542. The arcuated protruding body 542 further has an inner wheel connecting rod 5421 and an inner wheel connecting hole 5422. The inner wheel connecting rod 5321 of the inner wheel 53 engages the inner wheel connecting hole 5422 of the inner wheel 54, and the inner wheel connecting rod 5421 of the inner wheel 54 engages the inner wheel connecting hole 5322 of the inner wheel 53. In such manner, the inner wheels 53, 54 are securely inter-connected and are co-rotatable, and the inner wheel recesses 534, 544 of the inner wheels 53, 54 are juxtaposed and communicated with each other. It should be noted that, a length of each of the outer wheel recess 515, 526 in an axial direction of the shaft unit 9 is smaller that of the inner wheel recess 534, 544.

In this embodiment, the shape of the inner wheel central through holes 533, 543 are rectangular, and may be varied in other embodiments.

The rotary member 55 is coaxially disposed between the inner wheel bodies 531, 541 of the inner wheels 53, 54, extends partially out of the inner wheels 53, 54, and is rotatable relative to the inner wheels 53, 54. The rotary member 55 has a rotary member central through hole 551, a driving section 552 and a stopping section 553. A size of the rotary member central through hole 551 is smaller than the inner wheel central through holes 533, 543 of the inner wheels 53, 54. The driving section 552 and the stopping section 553 are spaced apart from each other, and the stopping section 553 is able to abut against the stop post 111 (see FIG. 1) mounted to the housing 1. In this embodiment, the shape of the rotary member central through hole 551 is rectangular, and may be varied in other embodiments.

The inner wheel body 541 has one end 5411 extending out of the outer wheel central through hole 521. The arm plate 56 is sleeved around the inner wheel body 541 of the inner wheel 54 outwardly of the outer wheel 52 for actuating the deadbolt 2, and has a driving arm 561, an arm central hole 563, and an arm arcuated hole 564 communicated with the arm central hole 563 at a radially off-center position, and alignable with the outer wheel arcuated opening 523. The end 5411 of the inner wheel body 541 is inserted fittingly into the arm central hole 563. The arm-driving tongue 545 of the inner wheel 54 radially projects from the inner wheel body 541 into the arm arcuated hole 564 of the arm plate 56 and the outer wheel arcuated opening 523, is limitedly rotatable within the arm arcuated hole 564 and the outer wheel arcuated opening 523, and is abutable with one end 5641 (see FIG. 10) of the arm arcuated hole 564 to push the arm plate 56. When the inner wheels 53, 54 are at a home position (see FIG. 10), the arm-driving tongue 545 of the inner wheel 54 is at a middle of the outer wheel arcuated opening 523, and at the end 5641 of the arm arcuated hole 564. Since the arm-driving tongue 545 is at the middle of the outer wheel arcuated opening 523, the inner wheels 53, 54 are rotatable either in the first and second directions (D1, D2) (see FIG. 11). Since the arm-driving tongue 545 is at the end 5641 of the arm arcuated hole 564, the arm-driving tongue 545 can abut against the end 5641 of the arm arcuated hole 564 to push the arm plate 56 so that the inner wheels 53, 54 drive the arm plate 56 when rotating in the first direction (D1). However, the arm-driving tongue 545 of the inner wheel 54 idles and does not drive the arm plate 56 when rotating in the second direction (D2).

Figure 6:
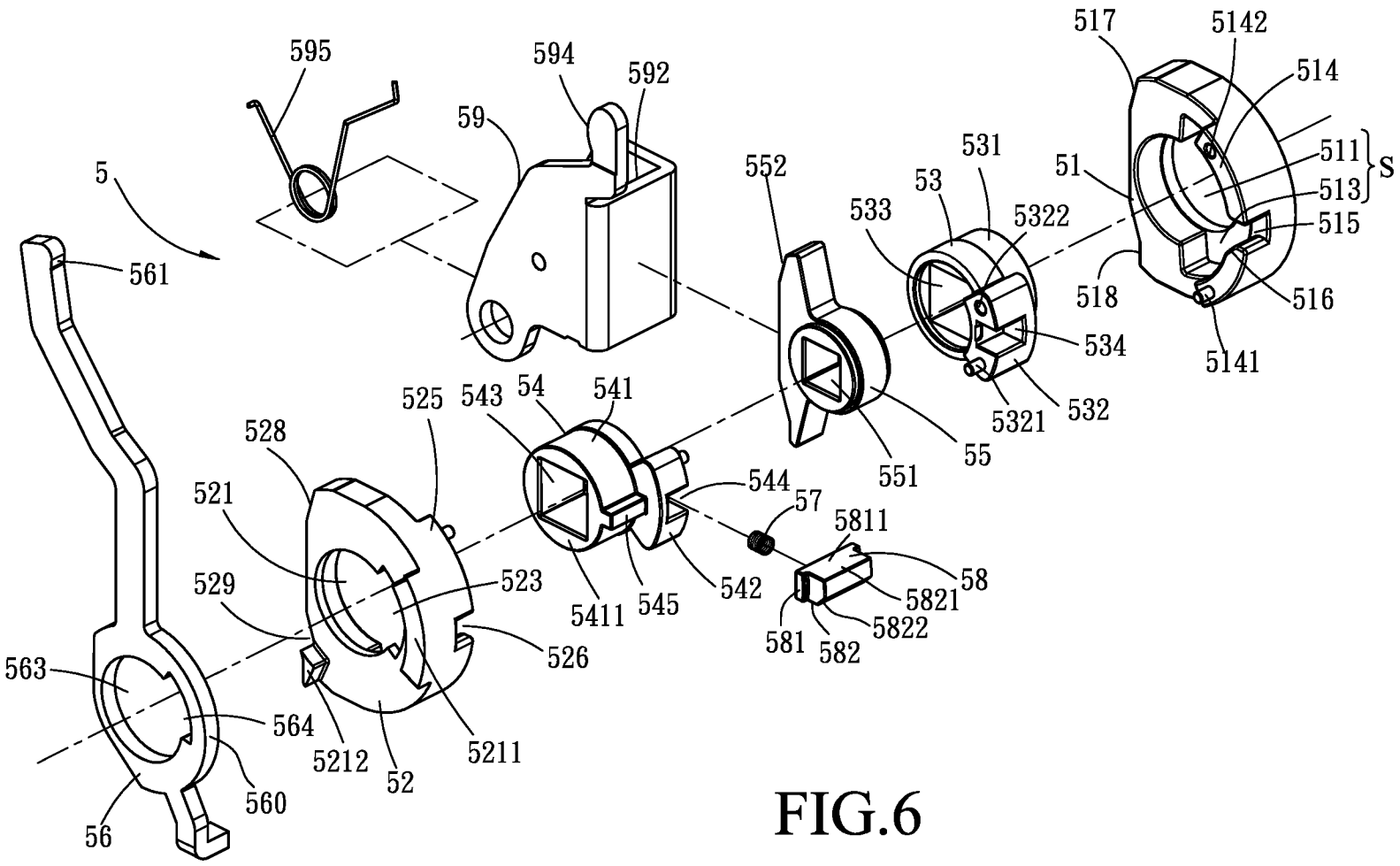
FIG. 6 is another exploded perspective view of the locking mechanism of the embodiment.
Figure 11:
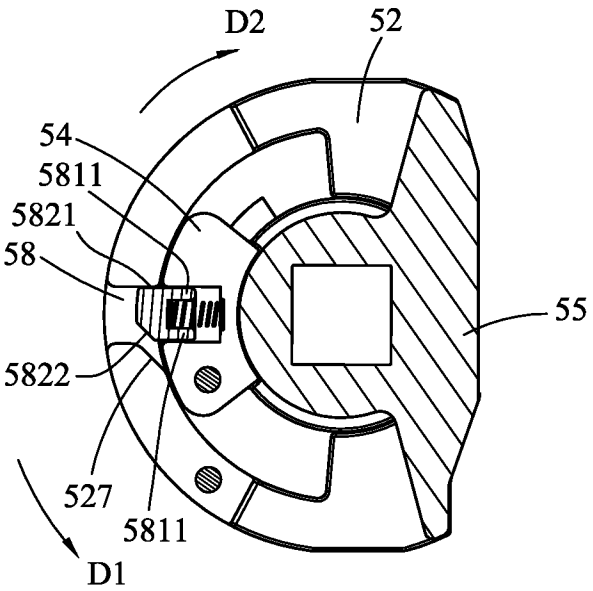
FIG. 11 is a fragmentary sectional view of the locking mechanism.
Figure 10:
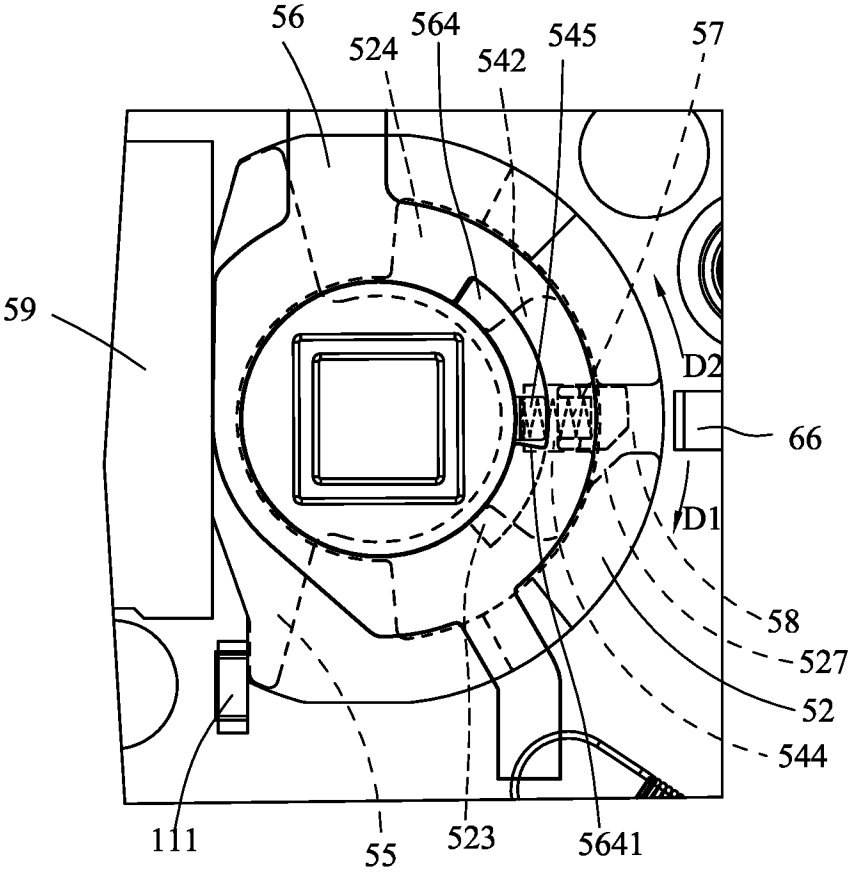
FIG. 10 is schematic side view of the locking mechanism when inner wheels of the locking mechanism are at a home position.

Both of the clutch spring 57 and the clutch member 58 are disposed in the inner wheel recesses 534, 544. As best shown in FIGS. 6 and 11, the clutch member 58 has a first part 581, and a second part 582 extended radially from the first part 581. A length of the first part 581 in the axial direction is larger than that of the second part 582. The first part 581 has two opposite parallel surfaces 5811 in a circumferential direction of the shaft unit 9, and the second part has a non-slanting surface 5821 extending radially from one of the two opposite parallel surfaces 5811 of the first part 581, and a slanting surface 5822 extending radially and obliquely from the other one of the two opposite parallel surfaces 5811. The second part 582 extends into the outer wheel recesses 515, 526 by a biasing action of the clutch spring 57. The clutch member 58 is urged by the clutch spring 57 to extend partially and radially into the outer wheel recesses 515, 526 so as to interengage the inner and outer wheels 51, 52, 53, 54, and is retractable into the inner wheel recesses 534, 544 from the outer wheel recesses 515, 526 to disengage the outer wheels 51, 52 from the inner wheels 53, 54 when the clutch member 58 is pushed against the clutch spring 57. When the inner wheels 53, 54 inter-engage with or disengage from the outer wheels 51, 52, rotation of the inner wheels 53, 54 in the first direction (D1) drives the arm plate 56 to actuate the deadbolt 2, and rotation of the inner wheels 53, 54 in the second direction (D2) is idle relative to the arm plate 56. When the inner wheels 53, 54 inter-engage the outer wheels 51, 52, rotation of the inner wheels 53, 54 in the second direction (D2) drives the outer wheels 51, 52, and rotation of the inner wheels 53, 54 in the first direction (D1) is idle relative to the outer wheels 51, 52. When the inner wheels 53, 54 disengage from the outer wheels 51, 52, rotation of the inner wheels 53, 54 in the first or second direction (D1, D2) is idle relative to the outer wheels 51, 52.

The latch pusher 59 is disposed in the housing 1 in proximity to the outer wheels 51, 52, and has an abutment wall 592, a driving protrusion 594 extending from the abutment wall 592, and a resilient member 595. The resilient member 595 has two ends respectively abutting against the housing 1 and one side of the abutment wall 592. The outer wheels 51, 52 and the rotary member 55 drive the latch pusher 59 to retract the latch bolt 3 when the inner wheels 53, 54 or the rotary member 55 rotate in the second direction (D2).

Figure 7:
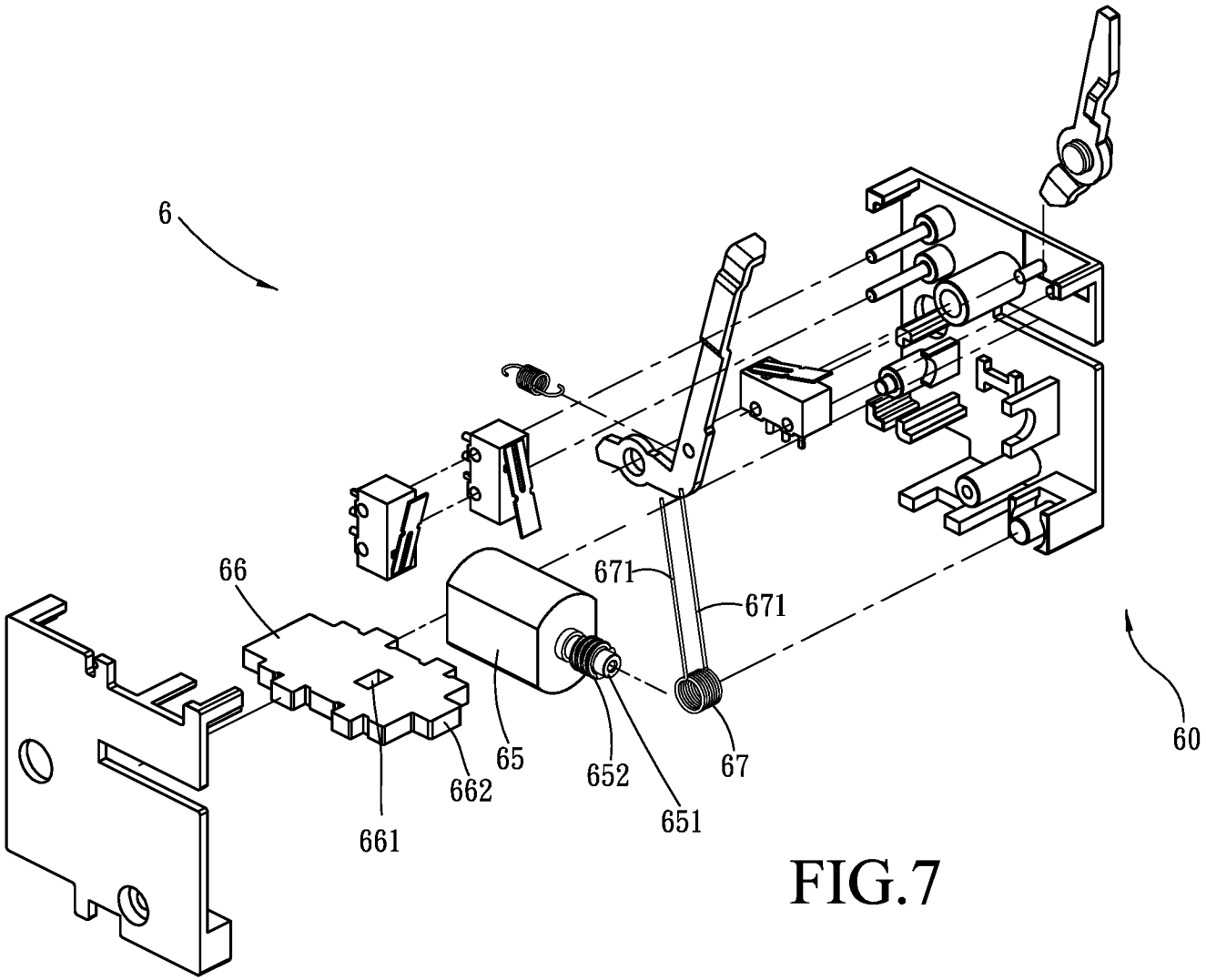
FIG. 7 is an exploded perspective view of an electronic controller of the embodiment.

Referring to FIGS. 1 and 7, the electronic controller 6 is mounted in the housing 1, and includes a shell 60, a motor 65, a triggering plate 66 and a control resilient member 67.

Figure 13:
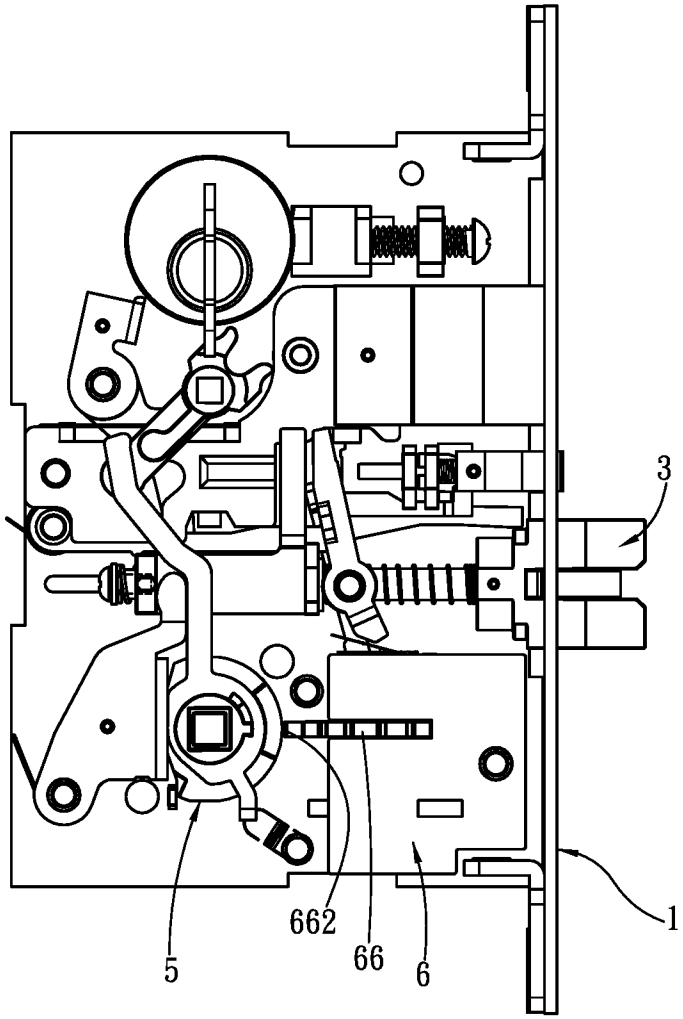
FIG. 13 is a side view of the door lock with a portion of a housing and a portion of a shell of the electronic controller omitted, wherein the deadbolt is at an unlocking position, and a triggering portion of a triggering plate of the electronic controller is separated from the locking mechanism.
Figure 15:
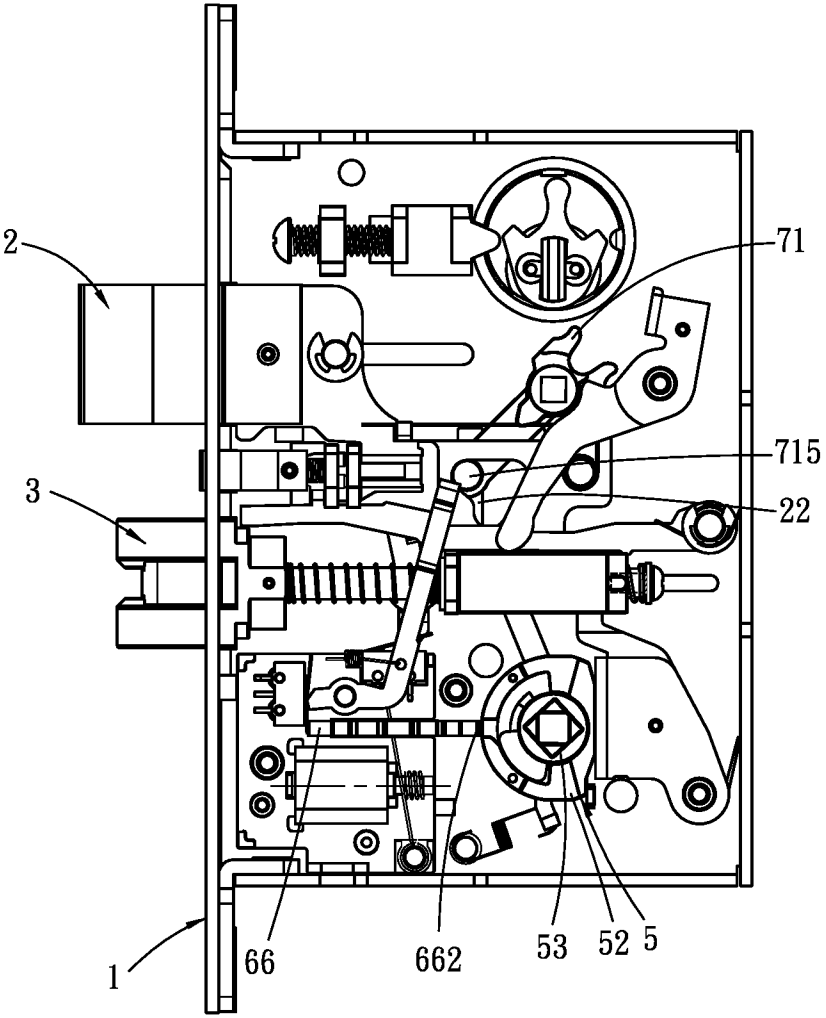
FIG. 15 is a side view of the door lock with the portion of the housing and the portion of the shell of the electronic controller omitted, wherein the deadbolt is at the locking position, and the triggering portion of the triggering plate of the electronic controller is separated from the locking mechanism.
Figure 18:
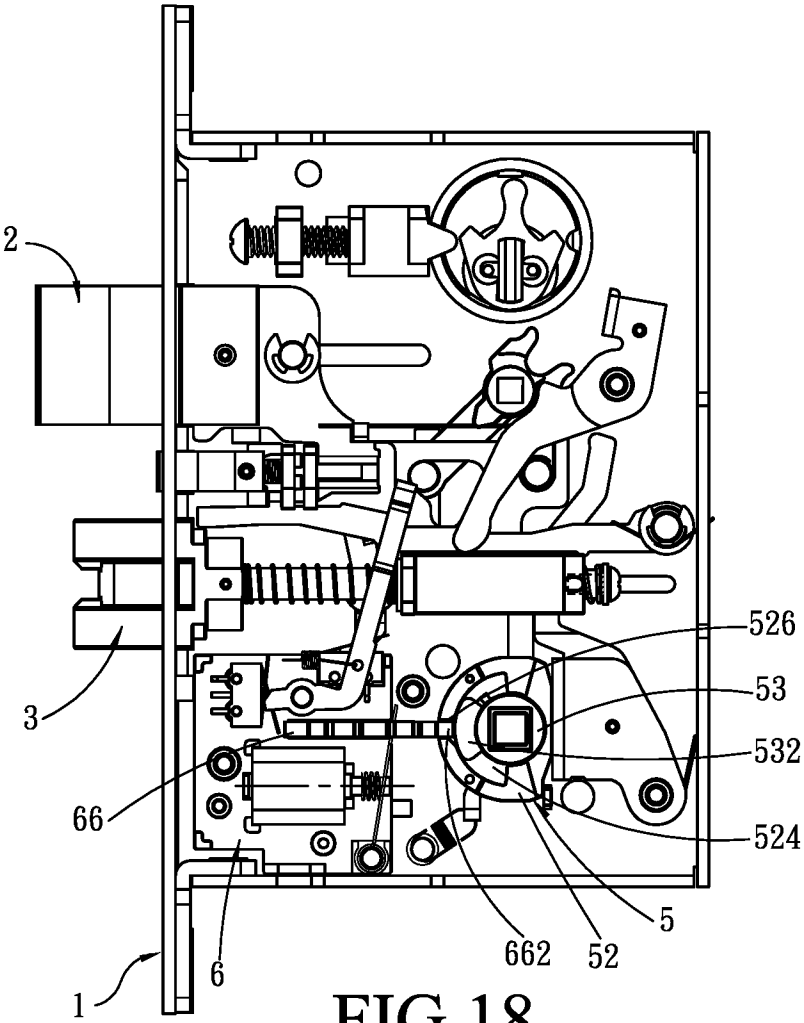
FIG. 18 is a view similar to FIG. 17 but with the inner wheels of the locking mechanism being at the home position.
Figure 17:
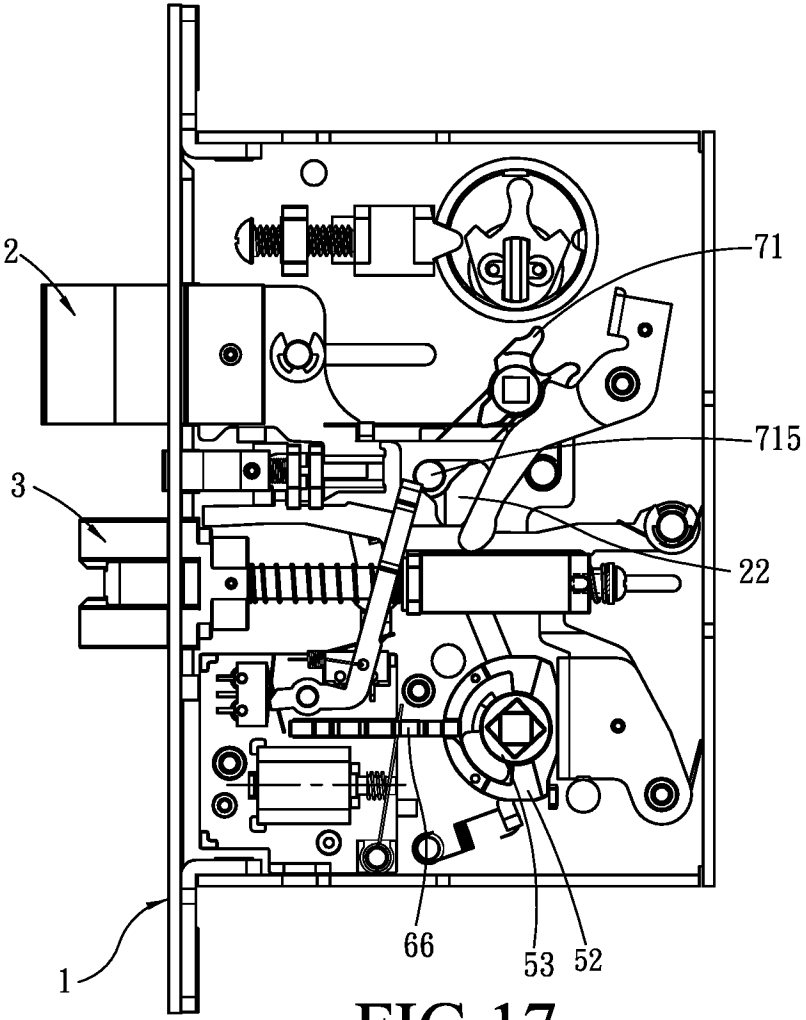
FIG. 17 is a view similar to FIG. 15, but with the triggering portion of the triggering plate being inserted into the locking mechanism.
Figure 20:
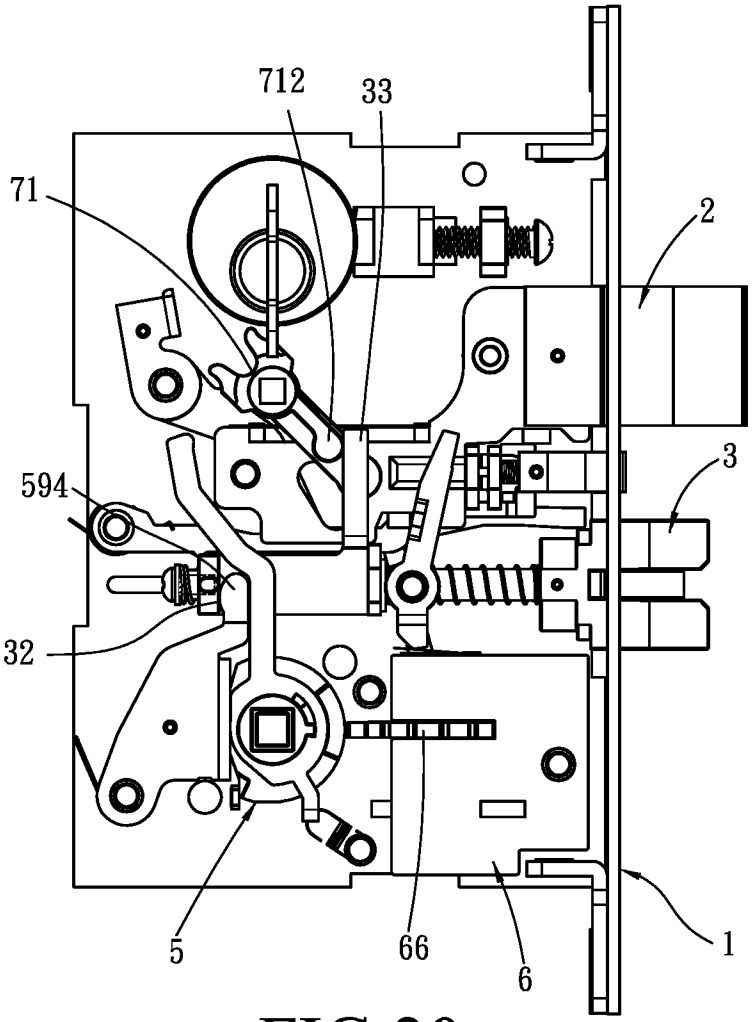
FIG. 20 is another side view that is viewed from an opposite side to the view of FIG. 19.
Figure 19:
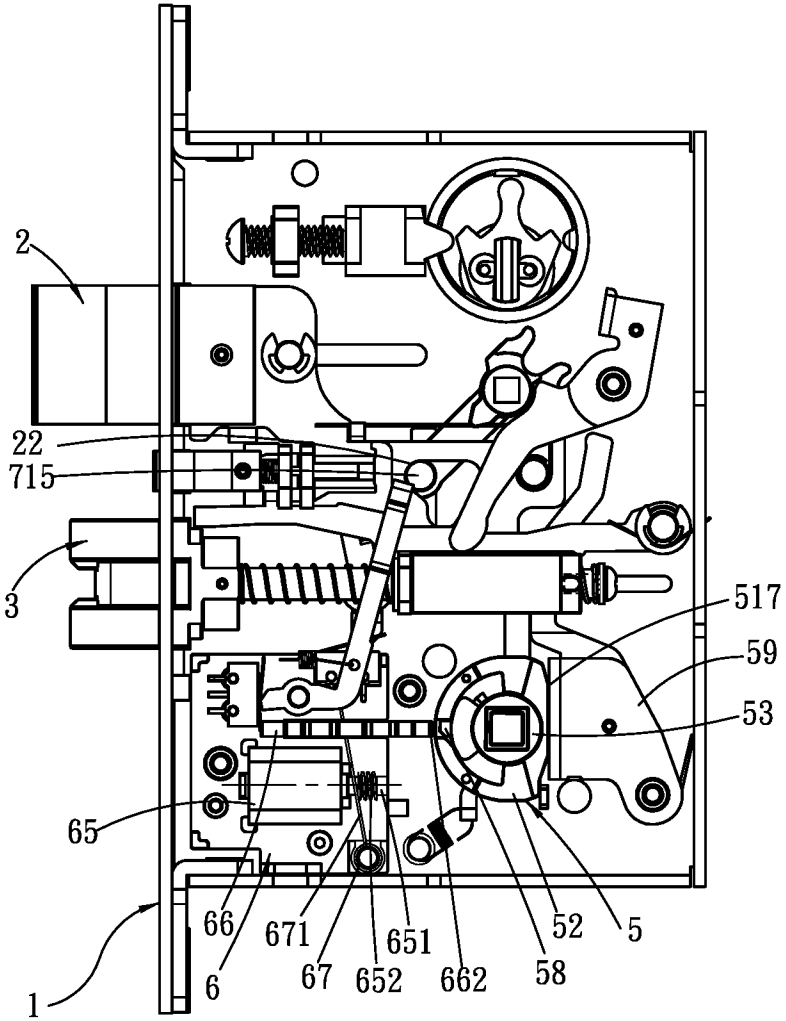
FIG. 19 is a side view of the door lock with the portion of the housing and the portion of the shell of the electronic controller omitted, wherein the deadbolt is at the locking position, and the inner wheels of the locking mechanism are at the home position.

The motor 65 is electrically connected to a control system (not shown), and has a rotary shaft 651 formed with a thread 652 on an outer surface of the rotary shaft 651. The control resilient member 67 is made of resilient stainless steel, and has two parallel resilient arms 671. The resilient arms 671 clamp the rotary shaft 651 of the motor 65 such that the resilient arms 671 engage the thread 652. The triggering plate 66 has a receiving hole 661 and a triggering portion 662. The resilient arms 671 are inserted into the receiving hole 661 of the triggering plate 66. The triggering plate 66 is operable to move toward and away from the locking mechanism 5 (see FIGS. 10, 13). When the triggering plate 66 moves toward the locking mechanism 5, the triggering portion 662 of the triggering plate 66 extends into the outer wheel recesses 515, 526 (see FIG. 18), and pushes the clutch member 58 against the clutch spring 57 so that the clutch member 58 retracts into the inner wheel recesses 534, 544 to disengage the inner wheels 53, 54 from the outer wheels 51, 52. When the triggering plate 66 moves away from the locking mechanism 5, the triggering portion 662 of the triggering plate 66 is separated from the outer wheel recesses 515, 526 (see FIG. 15), and the clutch member 58 extends into the outer wheel recesses 515, 526 to interengage the inner and outer wheels 51, 52, 53, 54. Since the resilient arms 671 of the control resilient member 67 clamp the rotary shaft 651 of the motor 65 and engage the thread 652, when the rotary shaft 651 rotates, the thread 652 drives the resilient arms 671 to move the triggering plate 66.

Figure 9:
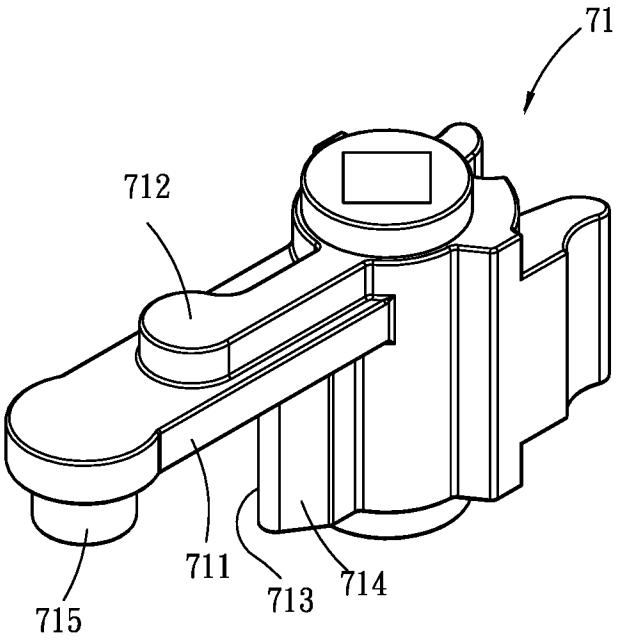
FIG. 9 is a perspective view of a deadbolt-actuating lever of the lever unit of the embodiment.
Figure 8:
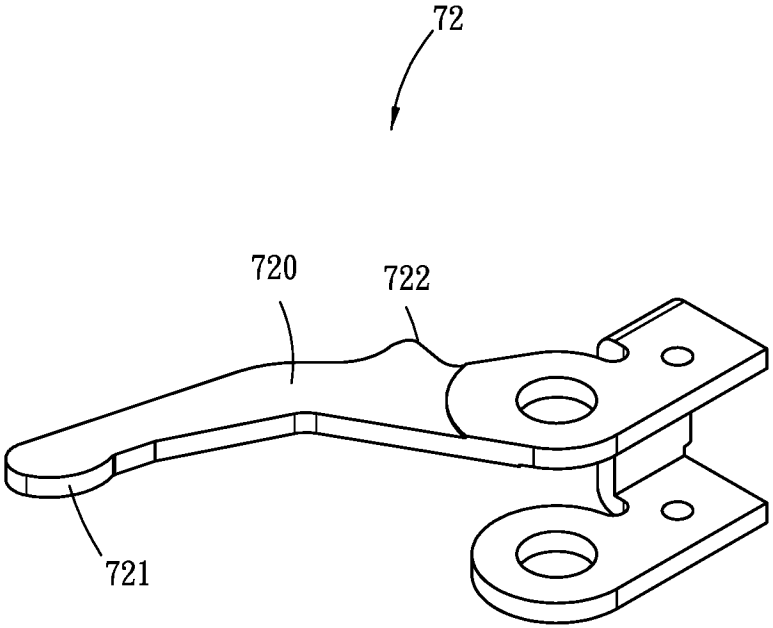
FIG. 8 is perspective view of a latch bolt-actuating lever of a lever unit of the embodiment.

Referring to FIGS. 1, 8 and 9, the lever unit 7 includes a deadbolt-actuating lever 71 and a latch bolt-actuating lever 72. The latch bolt-actuating lever 72 is disposed in the housing 1, and has a latch bolt-actuating lever arm 720 having a pushing portion 721 that is formed at a distal end of the latch bolt-actuating lever arm 720, and a cam portion 722. The pushing portion 721 is operable to drive the driven part 32 of the latch bolt 3.

Figure 16:
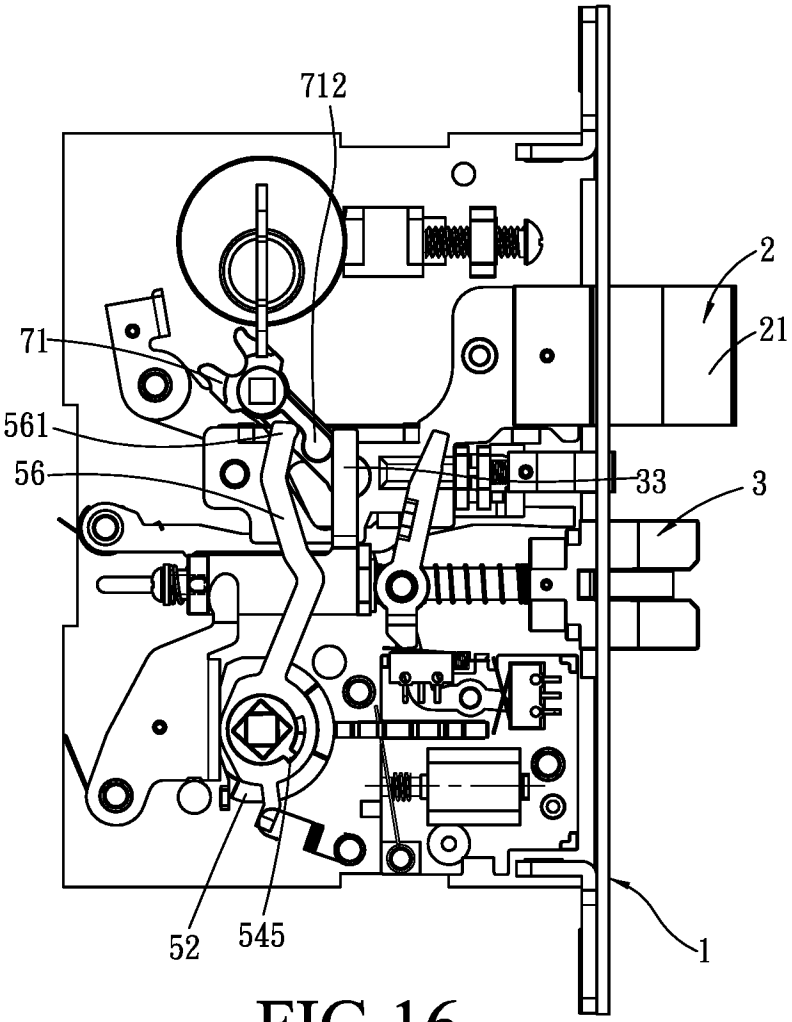
FIG. 16 is another side view that is viewed from an opposite side to the view of FIG. 15.

The deadbolt-actuating lever 71 is disposed in the housing 1, and has a deadbolt-actuating lever arm 711, a cam block 712 formed on the deadbolt-actuating lever arm 711, a first inclined surface 713, a second inclined surface 714 and an actuating portion 715. The first and second inclined surfaces 713, 714 are operable to drive the cam portion 722 of the latch bolt-actuating lever 72 to actuate an unlatching movement of the latch bolt 3. The actuating portion 715 is formed at a distal end of the deadbolt-actuating lever arm 711, and is operable to drive the coupling portion 22 of the deadbolt 2. The driving arm 561 of the arm plate 56 abuts the cam block 712 and moves the deadbolt-actuating lever 71 to push the deadbolt 2 to the locking position when the inner wheel 54 rotate in the first direction (D1) and drives the arm plate 56. During the unlatching movement of the latch bolt 3, the driving part 33 of the latch bolt 3 pushes the cam block 712 of the deadbolt-actuating lever 71 (see FIG. 16), so that deadbolt head 21 of the deadbolt 2 retracts from the locking position into the housing 1.

As shown in FIG. 12, the shaft unit 9 has a first shaft 90, and a second shaft 91. The first and second shafts 90, 91 are respectively connected to the inside and outside handles 92, 93. The first shaft 90 has a first section 901, a second section 902 having a diameter that is larger than that of the first section 901, and a third section 903 having a diameter that is larger than that of the second section 902. The first section 901 of the first shaft 90 extends fittingly into the rotary member 55, and the second section 902 of the first shaft 90 extends through the inner wheel 54. The second shaft 91 extends fittingly into the inner wheel 53. The first section 901, the third section 903 of the first shaft 90, and the second shaft 91 have a rectangular cross-section, and the second section 902 of the first shaft 90 has a circular cross-section.

Referring to FIGS. 6, 7, and 10 to 13, the electronic controller 6 is in an unlocking position, where the triggering portion 662 of the triggering plate 66 is separated from the outer wheel recesses 515, 526, and the clutch member 58 extends into the outer wheel recesses 515, 526. The user may press down either one of the inside and outside handles 92, 93 to open the door to which the box door lock of this embodiment is mounted. During the operation of opening the door, the outside handle 93 drives the inner wheels 53, 54 to rotate in the second direction (D2). Since the outer wheel recesses 515, 526 interlock with the non-slanting surface 5821 of the clutch member 58, the inner and outer wheels 51, 52, 53, 54 are interengaged with each other and rotate concomitantly. The arm-driving tongue 545 of the inner wheel 54 rotates in the second direction (D2) and idles in the arm arcuated hole 564 of the arm plate 56. When the user presses down the inside handle 92, the first section 901 of the first shaft 90 drives the rotary member 55 to rotate in the second direction (D2), and the second section 902 of the first shaft 90 idles in the inner wheel 54. The rotary member 55 thus drives the latch pusher 59 to actuate the unlatching movement of the latch bolt 3. When the user presses down the outside handle 93, the second shaft 91 drives the inner wheels 53, 54 to rotate in the second direction (D2), the inner wheels 53, 54 thus drive the outer wheels 51, 52 to drive the latch pusher 59 to actuate the unlatching movement of the latch bolt 3.

Referring to FIGS. 5, 6, 10, 11, 12, and 14 to 16, when the electronic controller 6 is in the unlocking position, where the triggering portion 662 of the triggering plate 66 is separated from the outer wheel recesses 515, 526, the user may lift or turn upward the outside handle 93 to switch the box door lock of the embodiment from an unlocked position (i.e., the deadbolt is at its unlocking position) to a locked position (i.e., the deadbolt is at its locking or outward extending position). When the outside handle 93 is turned upward, the inner wheels 53, 54 are rotated relative to the outer wheels 51, 52 in the first direction (D1). In this situation, the outer wheel inclined faces 516,527 interact with the slanting surface 5822 of the clutch member 58 so that the slanting surface 5822 of the second part 582 of the clutch member 58 is pressed into the inner wheel recesses 534, 544 thereby disengaging the inner wheels 53, 54 from the outer wheels 51, 52. The arm-driving tongue 545 of the inner wheel 54 rotates in the first direction (D1) and pushes the arm plate 56 to rotate relative to the outer wheels 51, 52 in the first direction (D1), and the driving arm 561 of the arm plate 56 pushes the cam block 712 of the deadbolt-actuating lever 71 so that the actuating portion 715 pushes the coupling portion 22 of the deadbolt 2 thereby driving the deadbolt 2 to the locking position.

Referring to FIGS. 5, 6, 8, 9, 11, 12, 17 and 18, the electronic controller 6 is in a locking position, the triggering portion 662 of the triggering plate 66 extends into the outer wheel recesses 515, 526, and the clutch member 58 retracts into the inner wheel recesses 534, 544. At this moment, the latch bolt 3 cannot be driven by pressing down the outside handle 93 by the user. But, the user may lift the outside handle 93 to drive the inner wheels 53, 54 in the first direction (D1). In such state, the inner wheels 53, 54 are disengaged from the outer wheels 51, 52, and the arm-driving tongue 545 pushes the arm plate 56 to rotate relative to the outer wheels 51, 52 in the first direction (D1), and the driving arm 561 of the arm plate 56 pushes the cam block 712 of the deadbolt-actuating lever 71 so that the actuating portion 715 pushes the coupling portion 22 of the deadbolt 2 thereby driving the deadbolt 2 to the locking position.

Referring to FIGS. 5, 6, 19 and 20, when the electronic controller 6 is operated to move the triggering plate 66 from its locking position to its unlocking position, the motor 65 is driven to rotate, and drives the resilient arms 671 of the control resilient member 67 by virtue of the thread 652. The resilient arms 671 then drive the triggering plate 66 to move away from the locking mechanism 5, so that the triggering portion 662 of the triggering plate 66 moves out of the outer wheel recesses 515, 526, and the inner wheels 53, 54 are interengaged with the outer wheels 51, 52. When the user presses down the outside handle 93 to retract the latch bolt 3, the driving part 33 of the latch bolt 3 pushes the cam block 712 of the deadbolt-actuating lever 71 so that the actuating portion 715 pushes the coupling portion 22 of the deadbolt 2 thereby driving the deadbolt 2 to the unlocking position from the locking position.

In conclusion, with the configuration of the locking mechanism 5, the object of the disclosure is achieved.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A door lock comprising a housing, a deadbolt movably mounted in said housing, and a locking mechanism, which includes:

an outer wheel rotatably mounted in said housing, and having a receiving space, and an outer wheel recess that communicates with said receiving space;

an inner wheel disposed partially and coaxially inside said receiving space of said outer wheel, and extending partially out of said outer wheel, said inner wheel being operable to rotate relative to said outer wheel in either one of two opposite first and second directions, and having an inner wheel recess that is alignable or misalignable with said outer wheel recess when said inner wheel rotates within said receiving space of said outer wheel, said inner wheel recess being radially juxtaposed with said outer wheel recess when being aligned with said outer wheel recess;

a clutch member and a clutch spring both of which are disposed in said inner wheel recess, said clutch member being urged by said clutch spring to extend partially and radially into said outer wheel recess so as to inter-engage said inner and outer wheels, said clutch member being retractable into said inner wheel recess from said outer wheel recess to disengage said outer wheel from said inner wheel when said clutch member is pushed against said clutch spring; and an arm plate sleeved around said inner wheel outwardly of said outer wheel for actuating said deadbolt, wherein when said inner wheel inter-engages with or disengages from said outer wheel, rotation of said inner wheel in the first direction drives said arm plate to actuate said deadbolt, and rotation of said inner wheel in the second direction is idle relative to said arm plate.

2. The door lock of claim 1, wherein:

said outer wheel further has an outer wheel central through hole, and an outer wheel arcuated opening adjacent to said arm plate, said outer wheel arcuated opening communicates with said outer wheel central through hole at a radially off-center position;

said arm plate has an arm central hole, and an arm arcuated hole that communicates with said arm central hole at a radially off-center position and is alignable with said outer wheel arcuated opening;

said inner wheel partially extends through said arm central hole; and said inner wheel further has an arm-driving tongue radially projecting from said inner wheel into said arm arcuated hole and said outer wheel arcuated opening, and being limitedly rotatable within said outer wheel arcuated opening, said arm-driving tongue being abutable with one end of said arm arcuated hole to drive said arm plate to actuate said deadbolt.

3. The door lock of claim 2, wherein said inner wheel is rotatable between a non-operated home position and an operated position, said arm-driving tongue is located at said one end of said arm arcuated hole when said inner wheel is at the non-operated home position, said arm-driving tongue abutting said one end of said arm arcuated hole to drive said arm plate when rotating in the first direction, and idling when rotating in the second direction.

4. The door lock of claim 2, further comprising a deadbolt-actuating lever disposed in said housing, said arm plate moving said deadbolt-actuating lever to push said deadbolt to a locking position when said inner wheel rotates in the first direction to cause said arm-driving tongue to drive said arm plate.

5. The door lock of claim 4, further comprising a latch bolt, said outer wheel actuating an unlatching movement of said latch bolt when said inner wheel rotates in the second direction and drives said outer wheel, said latch bolt having a driving part for pushing said deadbolt-actuating lever to retract said deadbolt from the locking position when said inner wheel rotates in the second direction and drives said outer wheel.

6. The door lock of claim 5, wherein said locking mechanism further includes a latch pusher disposed in said housing and proximate to said outer wheel, said outer wheel driving said latch pusher to retract said latch bolt when said inner wheel rotates in the second direction and drives said outer wheel.

7. The door lock of claim 6, wherein:

when said inner wheel is inter-engaged with said outer wheel, rotation of said inner wheel in the second direction drives said outer wheel, and rotation of said inner wheel in the first direction causes disengagement of said inner wheel from said outer wheel such that further rotation of said inner wheel in the first direction is idle relative to said outer wheel; and when said inner wheel is disengaged from said outer wheel by an electronic controller, rotation of said inner wheel in the first direction or the second direction is idle relative to said outer wheel.

8. The door lock of claim 2, wherein:

said outer wheel further has an outer wheel arcuated groove that communicates with said outer wheel central through hole at a radially off-center position, said outer wheel arcuated groove and said outer wheel central through hole cooperatively forming said receiving space, said outer wheel recess being radially juxtaposed with said outer wheel arcuated groove; and said inner wheel further has an inner wheel body extending through said outer wheel central through hole, and formed with an inner wheel central through hole, and an arcuated protruding body that radially protrudes from said inner wheel body, and that is received in said outer wheel arcuated groove, said arcuated protruding body having said inner wheel recess and being limitedly rotatable relative to said outer wheel arcuated groove.

9. The door lock of claim 8, wherein said arcuated protruding body of said inner wheel is located at a middle of said outer wheel arcuated groove when said inner wheel is at a non-operated home position.

10. The door lock of claim 8, wherein:

said outer wheel further has an outer wheel inclined face at a juncture of said outer wheel recess and said outer wheel arcuated groove, said clutch member having a first part, and a second part that is extended radially from said first part, said first part having two opposite parallel surfaces, said second part having a non-slanting surface that extends radially from one of said two opposite parallel surfaces of said first part, and a slanting surface that extends radially and obliquely from the other one of said two opposite parallel surfaces, said second part extending into said outer wheel recess by a biasing action of said clutch spring;

when said inner wheel rotates relative to said outer wheel in the first direction, said outer wheel inclined face interacts with said slanting surface to press said second part of said clutch member into said inner wheel recess and to thereby disengage said inner wheel from said outer wheel; and when said inner wheel rotates relative to said outer wheel in the second direction, said outer wheel recess interlocks with said non-slanting surface of said clutch member such that said inner and outer wheels inter-engage with each other.

11. The door lock of claim 8, wherein:

said inner wheel body has one end extending out of said outer wheel central through hole and inserted fittingly into said arm central hole such that said arm plate is sleeved around said inner wheel; and said outer wheel further has an axially projecting arcuated flange extending to and contacting a circumferential outer surface of said arm plate.

12. The door lock of claim 1, further comprising a shaft unit extending through said inner and outer wheel central through holes, and an outside handle connected to said shaft unit.

13. A door lock comprising:

a housing;

a deadbolt movably mounted in said housing;

a locking mechanism which includes two coaxially juxtaposed outer wheels, two inner wheels respectively and coaxially disposed in said outer wheels, a clutch member, a clutch spring, and an arm plate;

wherein each of said outer wheels is rotatably mounted in said housing, and each of said outer wheels has:

an outer wheel central through hole, an outer wheel arcuated groove that communicates with said outer wheel central through hole at a radially off-center position, and an outer wheel recess communicated with said outer wheel arcuated groove oppositely of said outer wheel central through hole, said outer wheel recess being radially juxtaposed with said outer wheel arcuated groove;

wherein each of said inner wheels has:

an inner wheel body extending through said outer wheel central through hole, and formed with an inner wheel central through hole, and an arcuated protruding body radially protruding from said inner wheel body, and said arcuated protruding body of each of said inner wheels is received in a corresponding one of said outer wheel arcuated grooves, said arcuated protruding body of each of said inner wheels being limitedly rotatable relative to said corresponding one of said outer wheel arcuated grooves, and having an inner wheel recess that is alignable or misalignable with a corresponding one of said outer wheel recesses; when said arcuated protruding body rotates within said corresponding one of said outer wheel arcuated grooves;

wherein said inner wheel recesses of said inner wheels are juxtaposed with each other, said outer wheel recesses of said outer wheels being juxtaposed with each other;

wherein said clutch member and said clutch spring are disposed in said inner wheel recesses, said clutch member being urged by said clutch spring to extend partially and radially into said outer wheel recesses so as to respectively inter-engage said inner wheels with said outer wheels, said clutch member being retractable into said inner wheel recesses from said outer wheel recesses to respectively disengage said outer wheels from said inner wheels when said clutch member is pushed against said clutch spring;

wherein said arm plate is sleeved around one of said inner wheels outwardly of a corresponding one of said outer wheels for actuating said deadbolt;

wherein, when said inner wheels are inter-engaged with or disengaged from said outer wheels, said one of said inner wheels drives said arm plate to actuate said deadbolt.

14. The door lock of claim 13, further comprising a latch bolt, said locking mechanism further including a latch pusher that is disposed in said housing and that is proximate to said outer wheels, said outer wheels driving said latch pusher to retract said latch bolt when said inner wheels inter-engage with said outer wheels.

15. The door lock of claim 13, wherein:

the corresponding one of said outer wheels further has an outer wheel arcuated opening adjacent to said arm plate and axially aligned with said corresponding outer wheel arcuated groove, and said outer wheel arcuated opening communicates with said corresponding outer wheel arcuated groove and said corresponding outer wheel central through hole;

said arm plate has an arm central hole, and an arm arcuated hole that communicates with said arm central hole at a radially off-center position and is alignable with said outer wheel arcuated opening, said inner wheel body of said one of said inner wheels extending through said arm central hole such that said arm plate is sleeved around said one of said inner wheels; and said one of said inner wheels further has an arm-driving tongue radially projecting from said inner wheel body into said arm arcuated hole and said outer wheel arcuated opening, and being limitedly rotatable within said arm arcuated hole and said outer wheel arcuated opening, said arm-driving tongue being abutable with one end of said arm arcuated hole to drive said arm plate to actuate said deadbolt.

16. The door lock of claim 15, wherein said inner wheels are rotatable between a non-operated home position and an operated position, said arm-driving tongue is located at said one end of said arm arcuated hole when said inner wheels are at the non-operated home position, said arm-driving tongue abutting said one end of said arm arcuated hole to drive said arm plate when rotating in a first direction, and idling when rotating in a second direction.

17. The door lock of claim 13, wherein:

each of said outer wheels further has an outer wheel inclined face at a juncture of said outer wheel recess and said outer wheel arcuated groove, said clutch member having a first part, and a second part that is extended radially from said first part, said first part having two opposite parallel surfaces, said second part having a non-slanting surface that extends radially from one of said two opposite parallel surfaces of said first part, and a slanting surface that extends radially and obliquely from the other one of said two opposite parallel surfaces, said second part extending into said outer wheel recesses by a biasing action of said clutch spring;

when said inner wheels rotate relative to said outer wheels in a first direction, said outer wheel inclined faces interact with said slanting surface to press said second part of said clutch member into said inner wheel recesses and to thereby disengage said inner wheels from said outer wheels; and when said inner wheels rotate relative to said outer wheels in a second direction, said outer wheel recesses interlock with said non-slanting surface of said clutch member such that said inner and outer wheels inter-engage with each other.

18. A door lock comprising a housing, a deadbolt movably mounted in said housing, a locking mechanism including:

at least one outer wheel that is rotatably mounted in said housing;

at least one inner wheel that is disposed coaxially inside said at least one outer wheel, said at least one inner wheel being operable to rotate relative to said at least one outer wheel in either one of two opposite first and second directions;

a clutch member that is disposed in said at least one inner wheel, and that is normally biased to radially and partially move from said at least one inner wheel into said at least one outer wheel so as to inter-engage said at least one inner wheel with said at least one outer wheel;

an arm plate that is sleeved around said at least one inner wheel outwardly of said at least one outer wheel for actuating said deadbolt, wherein:

when said at least one inner wheel inter-engages with or disengages from said at least one outer wheel, rotation of said at least one inner wheel in the first direction drives said arm plate to actuate said deadbolt, and rotation of said at least one inner wheel in the second direction is idle relative to said arm plate;

when said at least one inner wheel is inter-engaged with said at least one outer wheel, rotation of said at least one inner wheel in the second direction drives said at least one outer wheel, and rotation of said at least one inner wheel in the first direction causes disengagement of said at least one inner wheel from said at least one outer wheel such that further rotation of said at least one inner wheel in the first direction is idle relative to said at least one outer wheel; and when said at least one inner wheel is disengaged from said at least one outer wheel by an electronic controller, rotation of said at least one inner wheel in the first or second direction is idle relative to said at least one outer wheel.

19. The door lock of claim 18, further comprising a deadbolt-actuating lever disposed in said housing, said arm plate moving said deadbolt-actuating lever to push said deadbolt to a locking position when said at least one inner wheel rotates in the first direction and drives said arm plate.

20. The door lock of claim 19, further comprising a latch bolt, said at least one outer wheel actuating an unlatching movement of said latch bolt when said at least one inner wheel rotates in the second direction and drives said at least one outer wheel, said latch bolt having a driving part for pushing said deadbolt-actuating lever to retract said deadbolt from the locking position when said at least one inner wheel rotates in the second direction.

21. The door lock of claim 20, wherein said locking mechanism further includes a latch pusher disposed in said housing and proximate to said at least one outer wheel, said at least one outer wheel driving said latch pusher to retract said latch bolt when said at least one inner wheel rotates in the second direction.

22. The door lock of claim 18, wherein:

said at least one outer wheel has an outer wheel central through hole, and an outer wheel arcuated opening adjacent to said arm plate, and said outer wheel arcuated opening communicates with said outer wheel central through hole at a radially off-center position;

said arm plate has an arm central hole, and an arm arcuated hole that communicates with said arm central hole at a radially off-center position and is alignable with said outer wheel arcuated opening, said at least one inner wheel partially extending through said arm central hole; and said at least one inner wheel has an arm-driving tongue radially projecting from said at least one inner wheel into said arm arcuated hole and said outer wheel arcuated opening, and being limitedly rotatable within said outer wheel arcuated opening, said arm-driving tongue being abutable with one end of said arm arcuated hole to drive said arm plate to actuate said deadbolt.

23. The door lock of claim 22, wherein said at least one inner wheel is rotatable between a non-operated home position and an operated position, said arm-driving tongue is located at said one end of said arm arcuated hole when said at least one inner wheel is at the non-operated home position, said arm-driving tongue abutting said one end of said arm arcuated hole to drive said arm plate when rotating in the first direction, and idling when rotating in the second direction.

24. The door lock of claim 22, wherein:

said at least one inner wheel further has an inner wheel recess;

said at least one outer wheel further has an outer wheel recess, and an outer wheel inclined face at a juncture of said outer wheel recess and said outer wheel central through hole, said clutch member having a first part, and a second part that is extended radially from said first part, said first part having two opposite parallel surfaces, said second part having a non-slanting surface that extends radially from one of said two opposite parallel surfaces of said first part, and a slanting surface that extends radially and obliquely from the other one of said two opposite parallel surfaces, said second part extending into said outer wheel recess by a biasing action of said clutch spring;

when said at least one inner wheel rotates relative to said at least one outer wheel in the first direction, said outer wheel inclined face interacts with said slanting surface to press said second part of said clutch member into said inner wheel recess and to thereby disengage said at least one inner wheel from said at least one outer wheel; and when said at least one inner wheel rotates relative to said at least one outer wheel in the second direction, said outer wheel recess interlocks with said non-slanting surface of said clutch member such that said at least one inner and outer wheels inter-engage with each other.

* * * * *